US005261160A

United States Patent [19]

Castagna

[11] Patent Number: 5,261,160

[45] Date of Patent: Nov. 16, 1993

[54] NAIL CLIPPER AND CATCHER

[76] Inventor: Leonardo F. Castagna, 788 Commerce St., Thornwood, N.Y. 10594

[21] Appl. No.: 24,327

[22] Filed: Mar. 1, 1993

[51] Int. Cl.[5] ..... A45D 29/00

[52] U.S. Cl. ..... 30/28; 30/124; 132/75; 132/75.5

[58] Field of Search ..... 30/26, 28, 124; 132/75.5, 73, 75; D28/60

[56] References Cited

U.S. PATENT DOCUMENTS

| | | | |
|---|---|---|---|
| 612,990 | 10/1898 | Kiefaber | 30/28 |
| 1,081,896 | 12/1913 | Eckler | 30/28 |
| 1,290,380 | 1/1919 | Sims | 30/28 |
| 4,062,109 | 12/1977 | Min | 30/28 |
| 5,072,511 | 12/1991 | Ro | 30/28 |
| 5,131,146 | 7/1992 | Leininger | 30/28 |

*Primary Examiner*—Richard K. Seidel
*Assistant Examiner*—Hwei-Siu Payer

[57] ABSTRACT

A nail clipper with a catcher comprises a bottom container, a resilient top plate having connection at a rear end of the container to urge the top plate away from the container, the container having an upturned cutting edge at a front end of the container, the plate having a downturned cutting edge opposite to the upturned cutting edge, and a lever having a bent end portion with a shaft which engages a post mounted on the container for moving the plate up and down to clip nails, which clippings fall into the container. The shaft also forms a hole in the bent portion of the lever. A protrusion is provided on each side of the opening in the top plate. The lever is rotatable into three different positions. In a closed position, the two cutting edges are in contact so that the clippings container is closed. In the clipping position, the cutting edges are spaced from each other a sufficient distance to receive nails for clipping. In the emptying position, a relatively large spacing is provided between the cutting edges through which the clippings may be emptied when the cutting edges are faced downward.

5 Claims, 1 Drawing Sheet

NAIL CLIPPER AND CATCHER

BACKGROUND OF THE INVENTION

1. Field of the Invention

This invention relates to nail clippers and more particularly to nail clippers with catchers for receiving the clipped nails.

2. Description of the Related Art

U.S. Pat. No. 5,072,511 issued Dec. 17, 1991 to Abraham E. Ro for a Nail Clipper discloses a nail clipper comprising a bottom container, a top plate having connection means at a rear end to the container, the container having an upturned cutting edge at a front end of the container, the plate having a downturned cutting edge opposite to the upturned cutting edge, a lever having a shaft journaled in a post mounted on the container for deflecting the plate, and the container having front and rear clipping storage chambers. The top plate has an opening which can be covered by a swinging nail file rotationally attached to the plate. Nail clippings may be emptied from a rear chamber of the container by rotating the nail file away from the opening. They can also be emptied from a front chamber of the container through the space between the cutting edges.

U.S Pat. No. 2,179,435 issued Nov. 7, 1939 to P. H. Smith for a Nail Clipper discloses a similar nail clipper and container with an opening in the top plate coverable by the lever for emptying nail clippings.

U.S. Pat. No. 4,776,090 issued Oct. 11, 1988 to Mario R. Grassi for a Nail Clipper Catcher also discloses a nail clipper with a nail clipper catcher, which is emptied through an opening on a lower plate. However, Grassi has a removable nail clippings receptacle which substantially increases the cost of his clipper.

In the Ro and Smith patents, the nail clippings are emptied by rotating the nail file or lever away from the opening in the plate, facing the opening downward and trying to remove all of the clippings by shaking the clipper back and forth. But not all of the clippings are easily removed from their container without a relatively prolonged shaking of the clipper.

Also in the Ro patent, when the clippings are to be emptied from the front chamber through the space between the cutting edges, the cutting edges are still spaced relatively closely in the cutting position to make complete emptying difficult.

BRIEF SUMMARY OF THE INVENTION

A specific object of the invention is to provide an improved nail clipper with a nail clippings catcher which permits a rapid emptying of all of the clippings.

Another object of the invention is to provide a relatively simple mechanism for opening the nail catcher container.

A general object of the invention is to provide a nail clipper with a clippings container which is relatively simple to manufacture and use.

Briefly, in accordance with the invention, a nail clipper with catcher comprises a bottom container, a resilient top plate having connection means at a rear end of the container to urge the top plate away from the container, the container having an upturned cutting edge at a front end of the container, the top plate having a downturned cutting edge opposite to the upturned cutting edge, and a lever having a bent end portion with a shaft which engages a post mounted on the container for moving the top plate up and down to clip nails, which clippings fall into the container. The shaft also forms an opening in the bent end portion of the lever. A semicircular protrusion is provided on each side of the hole in the top plate. The lever is rotatable into three different positions. In a closed position the lever is parallel and adjacent to the top plate with its bent end portion directed downward in contact with the top of each of the protrusions, and the two cutting edges are in contact so that the clippings container is closed. In the clipping position, the lever is rotated from the closed position to project upwards from and parallel the top plate with its bent end portion directed upward in contact underneath with the right side slope of the protrusions, leaving the cutting edges spaced from each other a sufficient distance to receive nails for clipping. In the emptying position the lever is rotated sideways about 90 degrees away from the top plate so that the opening in its bent end portion receives one of the protrusions, and the resilient top plate is urged further from the container than when the lever is in the clipping position, to provide a relatively large spacing between the cutting edges through which the clippings may be emptied when the cutting edges are faced downward.

A feature of the invention is a post with a reduced neck portion to provide additional space to empty the clippings around the post when the clipper is in the emptying position.

An advantage of the invention is that it is simple to manufacture and operate.

BRIEF DESCRIPTION OF THE DRAWINGS

Other objects, features and advantages of the invention will be apparent from the following Description of the Preferred Embodiment taken together with the accompanying drawings in which.

DESCRIPTION OF THE PREFERRED EMBODIMENT

Figure 1:
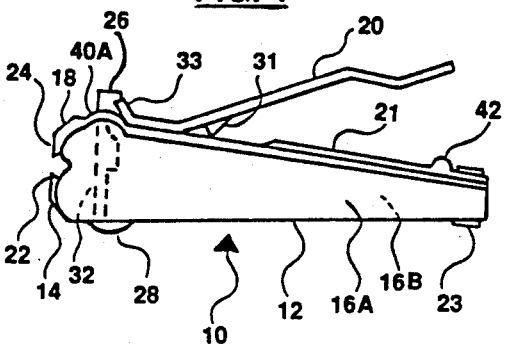
FIG. 1 is a side elevational view of the nail clipper in accordance with the preferred embodiment of the invention, with the lever in the clipping position.
Figure 2:
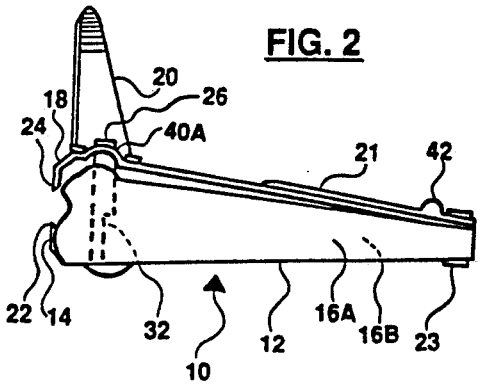
FIG. 2 is a side elevational view of the nail clipper of FIG. 1 with the lever in the emptying position.

Referring to FIG. 1 of the drawings, nail clipper 10 comprises a container 12 having a bottom plate 14 with side walls **16*a* and 16*b*, a resilient top plate 18, a lever 20 and a nail file 21**.

Bottom plate 14 is connected to resilient top plate 18 at their ends by rivet 23. Bottom plate 14 has an upturned cutting edge 22 at its other end. Resilient top plate 18 has a downturned cutting edge 24 at its other end which opposes cutting edge 22.

A cylindrical post 26 (also see FIG. 5) has a head 28 at one end, a groove 30 at the other end and a reduced neck portion 32 in between. The post 26 (FIG. 1) passes through a hole (not shown) in the bottom plate 14 and a hole 29 in the resilient top plate 18.

Figure 4:
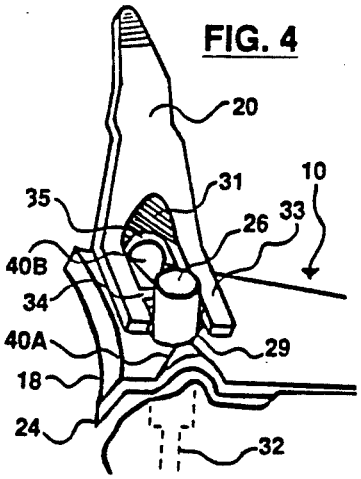
FIG. 4 is perspective view of an enlarged portion of the front of the nail clipper shown in FIG. 2 showing how a protrusion is received in the opening at the bent end portion of the lever.

Lever 20 has a bent end portion 33 (FIG. 4) with a shaft 34 which engages the groove 30 of post 26. Shaft 34 forms an opening 35 at the end of lever 20. Lever 20 also has a heel portion 31 which functions as a fulcrum for operating the lever 20.

Protrusions 40A and 40B are positioned on each side of the hole 29 in the resilient top plate 18. Protrusions 40A and 40B are semicircular and formed by bending the top plate 18 upwards.

The nail file 21 is rotationally connected to top plate 18 by rivet 23. The end of lever 20 is positioned between guide studs 42 at the end of nail file 21 when the clipper 10 is in the closed position.

OPERATION

FIG. 1 shows the nail clipper 10 in the clipping position with the lever 20 in the raised position. Nails to be clipped are inserted between the cutting edges 22 and 24 and the lever 20 is then urged towards the top plate 18 to bring the cutting edges 22 and 24 together to clip the nail. The nail clipping is ejected rearward into the container 12. The preferred spacing between the cutting edges 22 and 24 in the cutting position is one-sixteenth inch.

Figure 3:
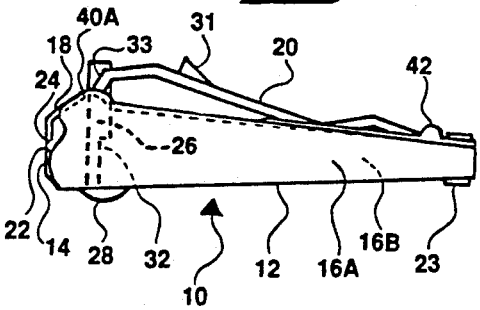
FIG. 3 is a side elevational view of the nail clipper of FIG. 1 with the lever in the closed position.

After all of the nails are clipped, lever 20 is rotated to the closed position shown in FIG. 3. In the closed position cutting edges 22 and 24 are in contact thus closing container 12.

After a sequence of nail clippings has been collected in container 12, the container 12 may be emptied by rotating the lever 20 ninety degrees to either side of resilient top plate 18 until the corresponding protrusion 40 is received in opening 35 at the bent end portion of lever 20.

The post 26 has a length larger than the length of a post in a standard nail clipper. When the protrusion 40 is received in the opening 35 the spacing between the cutting edges 22 and 24 is in the range of one-eighth inch to three-sixteenth inch, preferably three-sixteenth inch. In that emptying position the nail clipper 10 may be turned into a vertical position with the spaced edges downward to empty the container 12 of the accumulated nail clippings.

Figure 5:
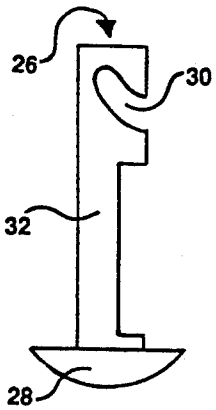
FIG. 5 is a side elevational view of the side of the post showing the reduced neck portion to facilitate emptying of the clippings.
Figure 5A:
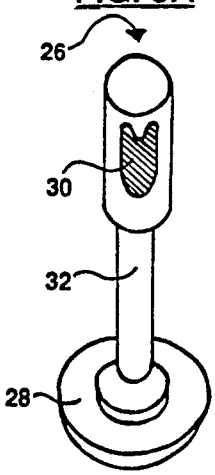
FIG. 5A is an enlarged view of the post with the reduced neck portion comprising a smaller diameter of the post in accordance with one feature of the invention.
Figure 5B:
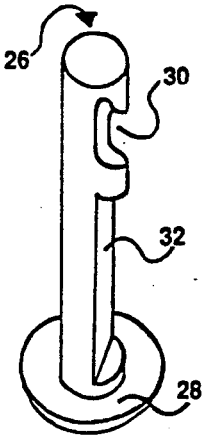
FIG. 5B is an enlarged view of the post with the reduced neck portion comprising a ground out portion of the post in accordance with another feature of the invention.

When the lever 20 is rotated to the emptying position, post 26 is also rotated so that the reduced neck portion 32 is closer to either side wall 16A or 16B of the container 12 to provide an ample opening for transferring the nail clippings from the container 12 through the spaced cutting edges 22 and 24. FIG. 5-B shows another feature of post 26 with the reduce neck portion comprising a ground out portion of the post in accordance with another feature of the invention.

What is claimed is:

1. A nail clipper with catcher for catching nail clippings comprising:

(a) a container having a bottom plate and an orthogonal side wall on each side of the bottom plate;

(b) a resilient top plate having connection means at a rear end of said container to urge said top plate away from said container;

(c) said container having an upturned cutting edge at a front end of said container;

(d) said resilient top plate having a downturned cutting edge opposite to the upturned cutting edge of said container;

(e) a post orthogonal to and slidingly connecting the front end of said resilient top plate to the front end of said container, said post projecting through a hole provided on said resilient top plate;

(f) a lever having a bent end portion with a shaft which engages said post mounted for moving said resilient top plate up and down to clip nails, which clippings are ejected into said container;

(g) said shaft of the bent end portion of said lever forming an opening in the bent end portion of said lever;

(h) a pair of aligned protrusions, each protrusion projecting upwardly from said resilient top plate, said hole disposed between said protrusions;

(i) said lever being rotatable with respect to said resilient top plate into a closed position, a clipping position and an emptying position;

(j) whereby when said lever is in the closed position, said lever is parallel and adjacent to said resilient top plate with its bent end portion directed downward in contact with each of said protrusions, and the two cutting edges are in contact, closing said container;

(k) and whereby when said lever is in the clipping position, said lever is rotated from the closed position to project upwards from and parallel to said resilient top plate with its bent end portion directed upwardly engaging said protrusions, and the cutting edges are spaced from each other a sufficient distance to receive nails for clipping when said lever is urged against said resilient top plate;

(l) and whereby when said lever is in the emptying position, said lever is rotated sideways about 90 degrees away from said resilient top plate so that the opening in its bent end portion receives one of said protrusions, and the resilient top plate is urged further from said container than when the lever is in the clipping position, to provide a substantially large spacing between the cutting edges through which the clippings may be emptied when the cutting edges are faced downward.

2. A nail clipper with catcher according to claim 1 wherein said post has a head at one end and a groove at the other end with a reduced neck portion between said ends to provide ample space to empty clippings from said container when in the emptying position.

3. A nail clipper with catcher according to claim 2 wherein the space provided by said reduced neck portion of said post is perpendicular to the length of said container when said lever is in the emptying position.

4. A nail clipper with catcher according to claim 1 wherein the spacing between the cutting edges of said container and said resilient top plate is substantially one-sixteenth of an inch when said lever is in the clipping position.

5. A nail clipper with catcher according to claim 1 wherein the spacing between the cutting edges of said bottom container and said resilient top plate is in the range from substantially one-eighth of an inch to substantially three-sixteenth of an inch when said lever is in the emptying position.

* * * * *